US006454560B1

(12) United States Patent
Chen

(10) Patent No.: US 6,454,560 B1
(45) Date of Patent: Sep. 24, 2002

(54) CHILD RESISTANT PIEZOELECTRIC LIGHTER

(76) Inventor: Peter Chen, 11135 E. Rush St., Unit B, South El Monte, CA (US) 91733

( * ) Notice: Subject to any disclaimer, the term of this patent is extended or adjusted under 35 U.S.C. 154(b) by 0 days.

(21) Appl. No.: 09/702,073

(22) Filed: Oct. 31, 2000

(51) Int. Cl.[7] ..... F23D 11/36; F23Q 7/24
(52) U.S. Cl. ..... 431/153; 431/255
(58) Field of Search ..... 431/153, 255, 431/254, 344, 144, 156

(56) References Cited

U.S. PATENT DOCUMENTS

| | | | | | |
|---|---|---|---|---|---|
| 3,063,276 | A | * | 11/1962 | Cassan | 431/254 |
| 5,096,414 | A | * | 3/1992 | Zellweger | 431/153 |
| 5,531,591 | A | * | 7/1996 | Yamazaki | 431/153 |
| 5,662,466 | A | * | 9/1997 | Cheng | 431/153 |
| 5,833,448 | A | * | 11/1998 | Doucet et al. | 431/153 |
| 5,882,186 | A | * | 3/1999 | Kai Man | 431/153 |
| 6,123,541 | A | * | 9/2000 | Yang | 431/153 |
| 6,273,709 | B1 | * | 8/2001 | Potskhishvili et al. | 431/153 |

FOREIGN PATENT DOCUMENTS

| | | | | |
|---|---|---|---|---|
| JP | 5-157235 | A | * 6/1993 | 431/153 |
| JP | 11-304148 | A | * 11/1999 | 431/153 |

* cited by examiner

*Primary Examiner*—Henry Bennett
*Assistant Examiner*—Josiah C. Cocks
(74) *Attorney, Agent, or Firm*—Raymond Y. Chan; David and Raymond Patent Group

(57) ABSTRACT

A piezoelectric lighter incorporates with a child resistance arrangement which includes a pair of protective walls each having an inner surface substantially extended from a ceiling of a casing to an outer wall thereof wherein a receiving chamber is defined between the two protective walls, and an ignition button slidably disposed in the receiving chamber and positioned between the inner surfaces of the protective walls in a radially movably manner, wherein the ignition button is positioned below top ceilings of the two protective walls at a predetermined depth, so as to form a physical barrier to prevent a thumb of a child from fully engaging the ignition button to ignite the piezoelectric lighter.

12 Claims, 5 Drawing Sheets

CHILD RESISTANT PIEZOELECTRIC LIGHTER

BACKGROUND OF THE PRESENT INVENTION

1. Field of Invention

The present invention relates to piezoelectric lighters, and more particularly to a child resistance piezoelectric lighter for preventing under age children from the usage of the piezoelectric lighter.

2. Description of Related Arts

Piezoelectric lighters have been known and sold throughout the United States. The conventional push-down type piezoelectric lighter generally comprises a cap which covers on top of the lighter. In order to ignite the lighter, a user must open the cap and downwardly depress an ignition button. The cap can prevent the lighter from being ignited accidentally. However, it cannot stop children from the usage of the piezoelectric lighter.

To solve the drawbacks set forth above, the push-down type piezoelectric lighter may employ a safety switch to normally lock up the downwardly movement of the ignition button so as to prevent the depression of the ignition button. However, for some other slide-down type piezoelectric lighters, which ignition button must be pushed sidewardly and downwardly at the same time for ignition, the conventional safety switch which is designed for locking up the downwardly ignition button cannot fit the structure of such slide-down type piezoelectric lighter. In fact, there is not existing safety arrangement can effectively and economically fit the slide-down type piezoelectric lighter. Since both the government and the consumers in United States demand a safety device employed in every lighter to prevent unwanted ignition accidentally or by a child, such unprotected slide-down type piezoelectric lighters are generally not allowed to marketing in United States.

SUMMARY OF THE PRESENT INVENTION

A main object of the present invention is to provide a child resistance piezoelectric lighter for preventing under age children from using the piezoelectric lighter, which can only be ignited by an adult's thumb in purpose and can prevent the ignition button thereof from being rubbed with any object to accidentally ignite.

Another object of the present invention is to provide a child resistance piezoelectric lighter which can stop under age children from the usage of piezoelectric lighter by limitation of their physical capability.

Another object of the present invention is to provide a child resistance piezoelectric lighter wherein the piezoelectric lighter normally retains in a child resistance condition but also can automatically return to the child resistance condition after each ignition operation, so as to prevent any unwanted ignition of the piezoelectric lighter.

Another object of the present invention is to provide a child resistance piezoelectric lighter wherein the ignition of the piezoelectric lighter of the present invention requires a simple single-action operation by an adult's thumb instead of the conventional double-action operation.

Another object of the present invention is to provide a child resistance piezoelectric lighter wherein the child resistance arrangement does not require to alter its original structural design of the piezoelectric lighter, so as to minimize the manufacturing cost of incorporating the child resistance arrangement with every conventional piezoelectric lighter.

Accordingly, in order to accomplish the above objects, the present invention provides a child resistance piezoelectric lighter which comprises:

a casing receiving a liquefied gas storage;

a gas emitting nozzle appearing at a ceiling of the casing and communicating with the liquefied gas storage for controlling the flow of gas;

a piezoelectric unit, which is disposed in the casing for generating piezoelectricity, comprising a movable operating part extended upwardly and an ignition tip extended to a position closed with the gas emitting nozzle, wherein when the movable operating part is depressed downwardly, the ignition tip generates sparks to ignite the gas emitted from the gas emitting nozzle at the same time; and a child resistance arrangement, comprising:

a pair of protective walls each having an inner surface substantially extended from the ceiling of the casing to an outer wall of the casing wherein a receiving chamber is defined between the two protective walls; and an ignition button slidably disposed in the receiving chamber and positioned between the inner surfaces of the protective walls in a radially movably manner wherein the ignition button is attached to a top end of the piezoelectric unit and arranged in such a manner that when the ignition button is depressed sidewardly and downwardly at the same time, the movable operating part of the piezoelectric unit is depressed to ignite the piezoelectric lighter;

wherein the ignition button is positioned below top ceilings of the two protective walls at a predetermined depth, so as to form a physical barrier to prevent a thumb of a child from fully engaging the ignition button to ignite the piezoelectric lighter.

In order to ignite the piezoelectric lighter, an adult must intentionally depress his or her thumb downward until his or her thumb's surface is completely in contact with the ignition button. At the same time, the adult can frictionally depress the ignition button sidewardly and downwardly to ignite the piezoelectric lighter. Therefore, the small thumb of an under age child is physically unable to deform his or her thumb to contact with the ignition button and generate power and pressure to press the ignition button sidewardly and downwardly. Moreover, the piezoelectric lighter can only be ignited by the adult's thumb in purpose that can prevent the ignition button from being press with any object to accidentally ignite.

DETAILED DESCRIPTION OF THE PREFERRED EMBODIMENT

Figure 1:
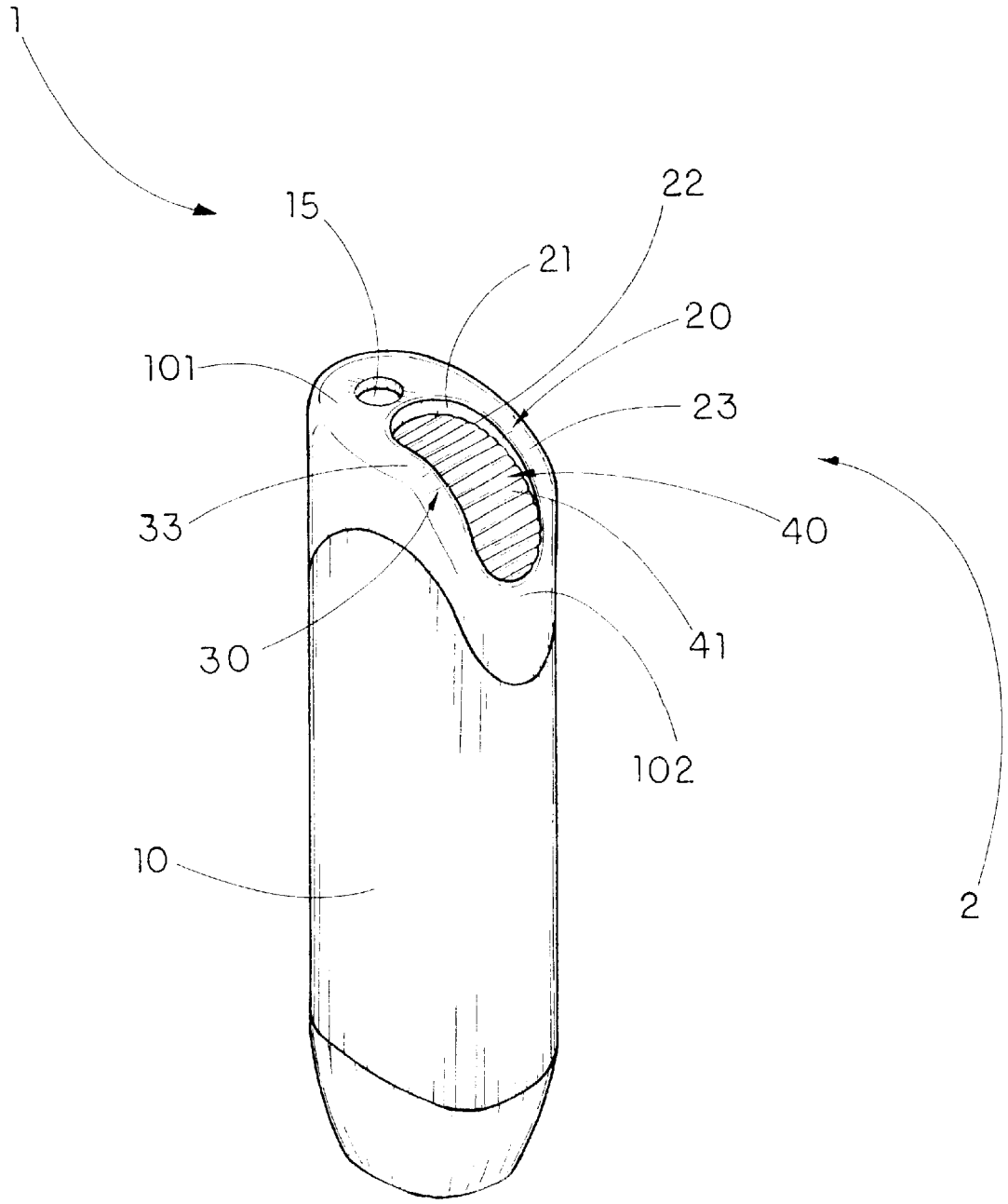
FIG. 1 is a perspective view of a child resistance piezoelectric lighter according to a first preferred embodiment of the present invention.

Referring to FIG. 1 of the drawings, a child resistance piezoelectric lighter 1 according to a first preferred embodiment of the present invention is illustrated. The piezoelectric lighter 1, such as a standard piezoelectric lighter, comprises a casing 10 having a liquefied gas storage 11, a gas emitting nozzle 15 appearing from a ceiling 101 of the casing 10 and communicating with the liquefied gas storage 11 for controlling the flow of gas.

A piezoelectric unit 13, which is disposed in the casing 10 for generating piezoelectricity, comprises a movable operating part 131 extended upwardly, and an ignition tip 16 extended to a position closed with the gas emitting nozzle 15, wherein when the movable operating part 131 is depressed downwardly, sparks are generated from the ignition tip 16 to ignite the gas emitted from the gas emitting nozzle 15 at the same time.

The piezoelectric lighter 1 further comprises a child resistance arrangement 2 which comprises a pair of protective walls 20, 30 and an ignition button 40.

Figure 2:
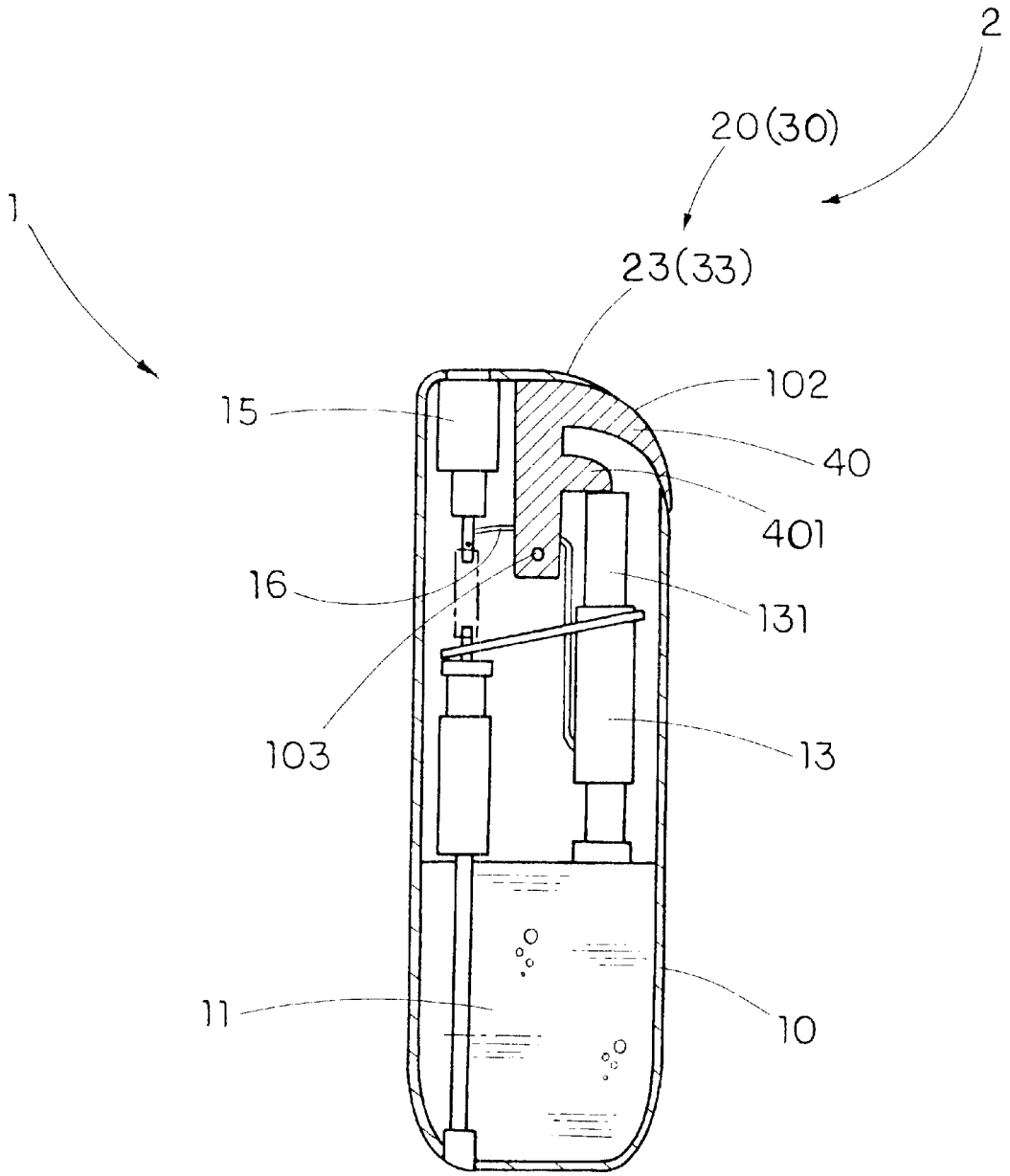
FIG. 2 is a sectional view of the child resistance piezoelectric lighter according to the above first preferred embodiment of the present invention.

Referring to FIG. 2, a pair of protective walls 20, 30 each having an inner surface 21, 31 substantially extended from the ceiling 101 of the casing 10 to a rear wall 102 of the casing 10 wherein a receiving chamber 22 is defined between the two protective walls 20, 30, and an ignition button 40 slidably disposed in the receiving chamber 22 and positioned between the inner surfaces 21, 31 of the protective walls 20, 30 in a radially movably manner.

The ignition button 40 is attached to a top end of the piezoelectric unit 13 and arranged in such a manner that when the ignition button 40 is depressed sidewardly and downwardly at the same time, the movable operating part 131 of the piezoelectric unit 13 is depressed to ignite the piezoelectric lighter 1.

The ignition button 40 is fittedly disposed in the receiving chamber 22 and slidably mounted between the inner surfaces 21, 31 of the two protective walls 20, 30 along the receiving chamber 22 in a radially movably manner about an operation axle 103 provided in the casing 10, wherein the ignition button 40 has a depressing arm 401 extended to rest on top of the movable operating part 131 of the piezoelectric unit 13 and arranged in such a manner that when the ignition button 40 is depressed sidewardly and downwardly at the same time, the depressing arm 401 will be driven to downwardly to depress the movable operating part 131 of the piezoelectric unit 13 to ignite the piezoelectric lighter 1.

The two parallel protective walls 20, 30, according to the preferred embodiment, are integrally and upwardly extended from the ceiling 101 of the casing 10 and positioned above the piezoelectric unit 13 wherein a top ceiling 23, 33 of each protective wall 20, 30 has a glossy outer surface which is smooth so as to prevent the piezoelectric lighter 1 from being ignited by a under age child or by an adult accidentally. Since children have already known to ignite the slide-down type lighter such as slide along a floor or other surface for generating a spark and possibly flames, the glossy top ceilings 23, 33 of the protective walls 20, 30 will serve to inhibit the generation of sparks and flames when the piezoelectric lighter is abused by the children in such a manner. Moreover, for insufficient force, even an adult's thumb will slip off the protective walls 20, 30 without causing the rotation of the ignition button and operation of the piezoelectric, so as to prevent an unintentional ignition.

Figure 3:
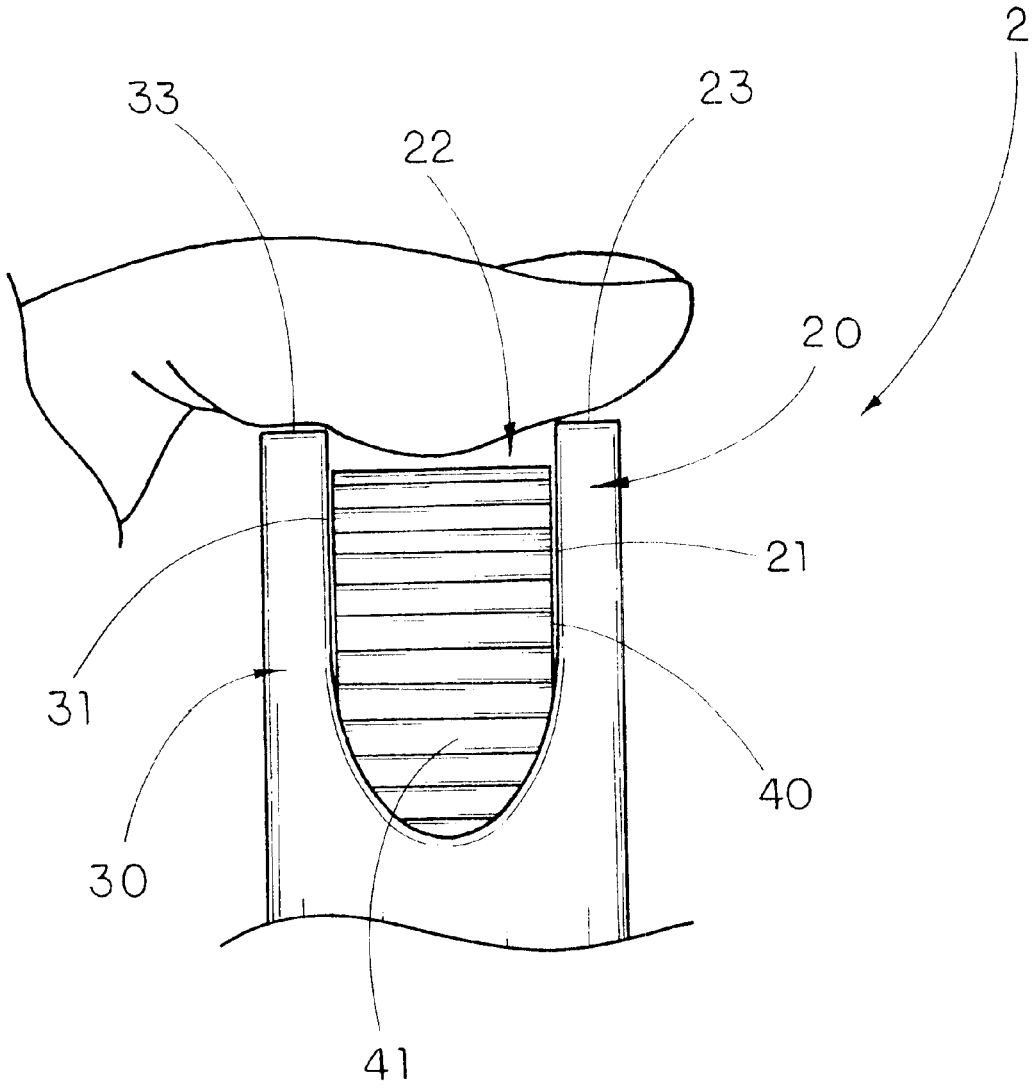
FIG. 3 is partial sectional view of the child resistance piezoelectric lighter according to the above first preferred embodiment of the present invention, illustrating an adult's thumb being deformed to ignite the piezoelectric lighter.

As shown in FIG. 3, the ignition button 40 has a top engaging, surface 41 for the adult's thumb frictionally contacting therewith wherein the top engaging surface 41 of the ignition button is positioned below the top ceilings 23, 33 of the two protective walls 20, 30 to form a safety groove having a predetermined depth above the ignition button 40 and between the protective walls 20 that acts as a physical barrier to prevent a thumb of a child from fully engaging the top engaging surface 41 of the ignition button, in such a manner that the adult's thumb must apply sufficient pressure on the ignition button 40 and deform his/her thumb's surface past the protective walls 20, 30 to frictionally in contact with the top engaging surface 41 of the ignition button 40.

Accordingly, the predetermined depth of the ignition button 40 is deep enough to prevent the child' thumb to deform his/her thumb's surface in order to fully contact the top engaging surface 41 of the ignition button 40. In other words, children are unable to depress the ignition button 40 sidewardly and downwardly for igniting the piezoelectric lighter 1. However, the adult's thumb is able to deform his/her thumb's surface to past the predetermined depth of the ignition button 40 in order to operate the piezoelectric lighter 1.

In order to enhance the frictionally engagement between the adult's thumb and the ignition button 40, the top engaging surface 41 is a rough surface such that when the adult's thumb forms his/her thumb's surface, his/her thumb is able to perfectly contact with the top engaging surface 41 of the ignition button 40, so as to depress the ignition button 40 sidewardly and downwardly to ignite the piezoelectric lighter 11.

Figure 4:
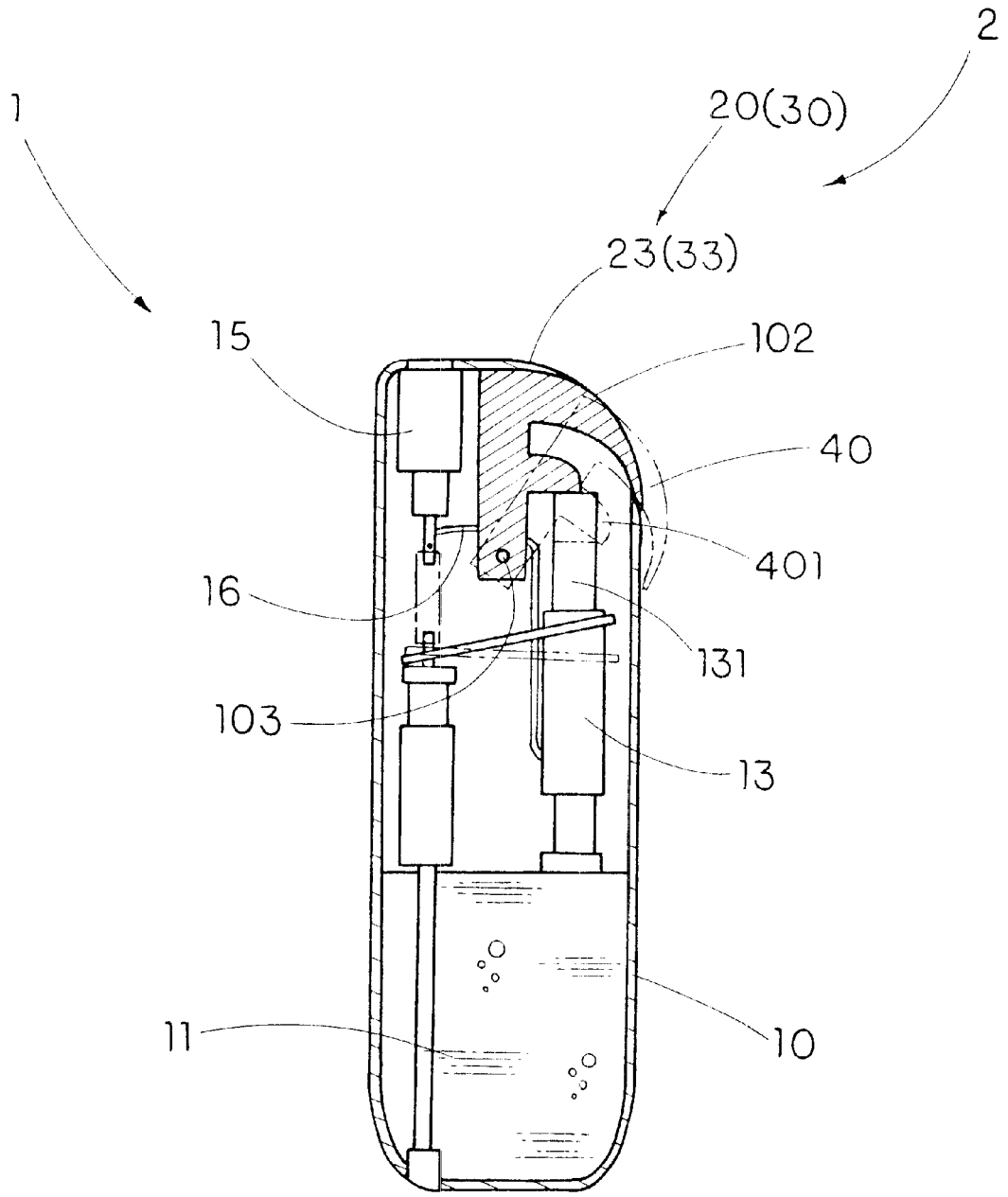
FIG. 4 is a sectional view of the child resistance piezoelectric lighter in an ignition position according to the above first preferred embodiment of the present invention

As shown in FIG. 4, in order to ignite the piezoelectric lighter 1, the adult's thumb must apply a sufficient pressure on the protective walls 20, 30 and deform his/her thumb's surface past the protective walls 20, 30 to frictionally contact the top engaging surface 41 of the ignition button 40. Once the adult's thumb is fully engaged with the top engaging surface 41 of the ignition button, a sideward force can be applied on the ignition button 40 to radially move the ignition button 40 sidewardly and compress the piezoelectric unit 13 for striking spark and ignite the piezoelectric lighter 1. While releasing the sideward on the ignition button 40, the compressed piezoelectric unit 13 will rebound to its original form which pushes the ignition button 40 back to its original position. So, the piezoelectric lighter 1 is not only normally retains in a child resistance condition but also can automatically return to the child resistance condition after every single ignition operation.

Figure 5:
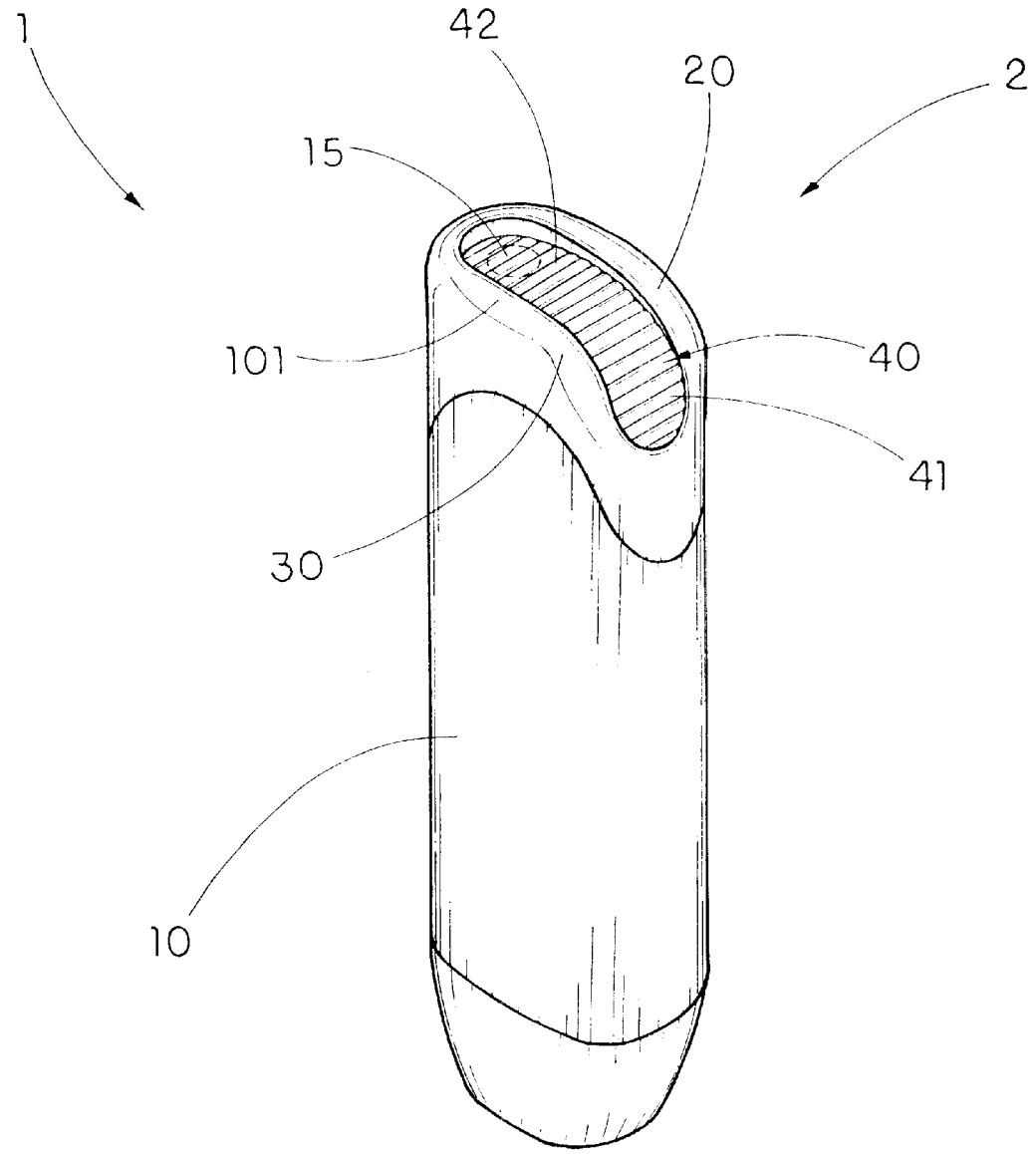
FIG. 5 is a perspective view of a child resistance piezoelectric lighter according to a second preferred embodiment of the present invention.

Referring to FIG. 5 of the drawings, a piezoelectric lighter 1' according to a second preferred embodiment of the present invention is illustrated, wherein the piezoelectric lighter 1' of the second embodiment basically is an alternative mode of the first embodiment, which is also formed a physical barrier to prevent a thumb of a child from fully engaging the ignition button 40'.

The two protective walls 20', 30' are integrally and upwardly extended towards to the gas emitting nozzle 15 to join each other and encircling the ceiling of the casing in such a manner that the gas emitting nozzle 15 is positioned below the protective walls 20', 30' between the inner surfaces 21', 31' thereof.

The ignition button 40' further comprises a lip cap 42' integrally and frontwardly extended to cover up the gas emitting nozzle 15 wherein the lip cap 42' is normally positioned between the two inner surfaces 21' 31' of the protective walls 20', 30'. When the ignition button 40' is being radially slid sidewardly, the lip cap 42' is arranged to being slid sidewardly to open up the gas emitting nozzle 15.

The lip cap 42' is used for protecting the gas emitting nozzle 15, so as to prevent dust or other materials directly entering into the gas emitting nozzle 15 in order to affect the operation of the piezoelectric lighter 1.

According to the first and second preferred embodiments as disclosed above, the piezoelectric lighter 1 of the present invention can stop under age children from using the lighter by limitation of their capability since they do not have sufficient power to deform their thumb in order to engage with the ignition button. Thus, the protective walls of the child resistance arrangement will act as a barrier to stop the ignition button in a radially movable manner in order to prevent the unintentional ignition. Also, the piezoelectric lighter is adapted for incorporating with the child resistance arrangement without any substantial change to the configuration of the lighter, so that the cost of the prevent invention is relatively inexpensive. No additional elements of such switching mechanism is required to incorporate with the piezoelectric lighter for ensuring the safety feature thereof. Therefore, the manufacturing procedure of the present invention is easy and in low cost.

What is claimed is:

1. A piezoelectric lighter, comprising:

a casing receiving a liquefied gas storage;

a gas emitting nozzle appearing at a ceiling of said casing and communicating with said liquefied gas storage for controlling a flow of gas;

a piezoelectric unit, which is disposed in said casing for generating piezoelectricity, comprising a movable operating part extended upwardly and an ignition tip extended to a position adjacent to said gas emitting nozzle, wherein when said movable operating part is depressed downwardly, said ignition tip generates sparks to ignite said gas emitted from said gas emitting nozzle at said same time: and a child resistance arrangement, comprising:

a top end of said casing integrally provided with a pair of protective walls which are upwardly extended from said ceiling to a rear wall of said casing, wherein each of said protective walls has an inner surface and a receiving chamber is defined between said two inner surfaces of said two protective walls and positioned above said piezoelectric unit; and an ignition button slidably mounted and extended between said inner surfaces of said protective walls inside said receiving chamber in a radially movably manner wherein said ignition button is coupled with said movable operating part of the piezoelectric unit and arranged to depress said movable operating part of said piezoelectric unit to ignite said piezoelectric lighter when said ignition button is depressed sidewardly and downwardly simultaneously;

wherein said ignition button is mounted to position below top ceilings of said two protective walls to form a physical safety groove having a predetermined depth above said ignition button and between said two protective walls that acts as a physical barrier to prevent a thumb of a child from fully engaging said ignition button to ignite said piezoelectric lighter.

2. A piezoelectric lighter, as recited in claim 1, wherein said top ceilings of said protective walls have glossy outer surfaces respectively.

3. A piezoelectric lighter, as recited in claim 1, wherein a top engaging surface of said ignition button is a rough surface in order to enhance the frictionally engagement between an adult's thumb and ignition button.

4. A piezoelectric lighter, as recited in claim 2, wherein a top engaging surface of said ignition button is a rough surface in order to enhance the frictionally engagement between an adult's thumb and ignition button.

5. A piezoelectric lighter, as recited in claim 1, wherein said two protective walls are integrally and upwardly extended towards to said gas emitting nozzle to join each other and encircling said ceiling of said casing in such a manner that said gas emitting nozzle is positioned below said protective walls between said inner surfaces thereof.

6. A piezoelectric lighter, as recited in claim 2, wherein said two protective walls are integrally and upwardly extended towards to said gas emitting nozzle to join each other and encircling said ceiling of said casing in such a manner that said gas emitting nozzle is positioned below said protective walls between said inner surfaces thereof.

7. A piezoelectric lighter, as recited in claim 3, wherein said two protective walls are integrally and upwardly extended towards to said gas emitting nozzle to join each other and encircling said ceiling of said casing in such a manner that said gas emitting nozzle is positioned below said protective walls between said inner surfaces thereof.

8. A piezoelectric lighter, as recited in claim 4, wherein said two protective walls are integrally and upwardly extended towards to said gas emitting nozzle to join each other and encircling said ceiling of said casing in such a manner that said gas emitting nozzle is positioned below said protective walls between said inner surfaces thereof.

9. A piezoelectric lighter, as recited in claim 5, wherein said ignition button further comprises a lip cap integrally and frontwardly extended to cover up said gas emitting nozzle, wherein said lip cap is normally positioned between said two inner surfaces of said protective walls.

10. A piezoelectric lighter, as recited in claim 6, wherein said ignition button further comprises a lip cap integrally and frontwardly extended to cover up said gas emitting nozzle, wherein said lip cap is normally positioned between said two inner surfaces of said protective walls.

11. A piezoelectric lighter, as recited in claim 7, wherein said ignition button further comprises a lip cap integrally and frontwardly extended to cover up said gas emitting nozzle, wherein said lip cap is normally positioned between said two inner surfaces of said protective walls.

12. A piezoelectric lighter, as recited in claim 8, wherein said ignition button further comprises a lip cap integrally and frontwardly extended to cover up said gas emitting nozzle, wherein said lip cap is normally positioned between said two inner surfaces of said protective walls.

* * * * *